United States Patent [19]

Siefert

[11] Patent Number: 4,720,820

[45] Date of Patent: Jan. 19, 1988

[54] CLOCK, IN PARTICULAR DESK OR WALL CLOCK, WITH ONE OR MORE ANALOG TIME INDICATING DEVICES

[76] Inventor: Roland Siefert, Im Herrengarten 6, D-7737 Bad Dürrheim, Fed. Rep. of Germany

[21] Appl. No.: 888,880

[22] Filed: Jul. 22, 1986

[30] Foreign Application Priority Data

Oct. 8, 1985 [DE] Fed. Rep. of Germany ..... 3535801

[51] Int. Cl.[4] ..... G04B 19/00; G04C 17/00

[52] U.S. Cl. ..... 368/76; 368/223

[58] Field of Search ..... 368/76, 77, 80, 220, 368/223–232

[56] References Cited

U.S. PATENT DOCUMENTS

| | | | |
|---|---|---|---|
| Re. 22,640 | 5/1945 | Prins | 368/77 |
| 239,738 | 4/1981 | Dee | 368/228 |
| 1,432,566 | 10/1922 | Metcalfe | 368/228 |
| 1,850,184 | 3/1932 | Spainhower | 368/223 |
| 2,243,343 | 5/1941 | Johnson | 368/228 |
| 3,106,617 | 10/1963 | Ducommun | 368/76 |
| 4,370,063 | 1/1983 | Lee | 368/76 |

FOREIGN PATENT DOCUMENTS

| | | | |
|---|---|---|---|
| 784380 | 7/1935 | France | 368/223 |

*Primary Examiner*—Vit W. Miska
*Attorney, Agent, or Firm*—McGlew and Tuttle

[57] ABSTRACT

Clock, having three or four hand systems at right angles to each other about a clock movement vertical axis and whose hand system axes are horizontal and intersect the vertical axis, each hand system coaxially including a minute hand shaft and crown gear and an hour hand shaft and crown gear, with the minute crown gears meshing with a common minute transmission gear and the hour crown gears meshing with a common hour transmission gear in the manner of angle gears, the transmission gears being coaxial to the vertical axis and driven by corresponding clock movement shafts, the corresponding crown gears and transmission gears respectively having the same number of teeth and of tooth profile like that of a in which the teeth in mutual engagement have a profile displacement or V-plus gear, and each transmission gear having a diameter larger by at least double the tooth depth than the diameter of the corresponding crown gears; and clock related rotary dummy pendulum, four face clock support cube like shape hollow part, and/or bearing surface containing side post and rectangular side wall housing, arrangements.

22 Claims, 12 Drawing Figures

Fig. 5
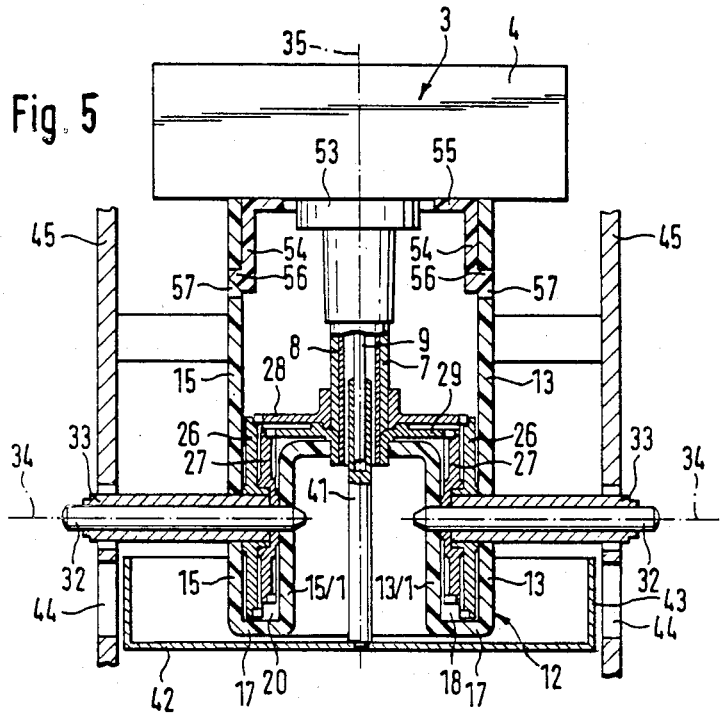
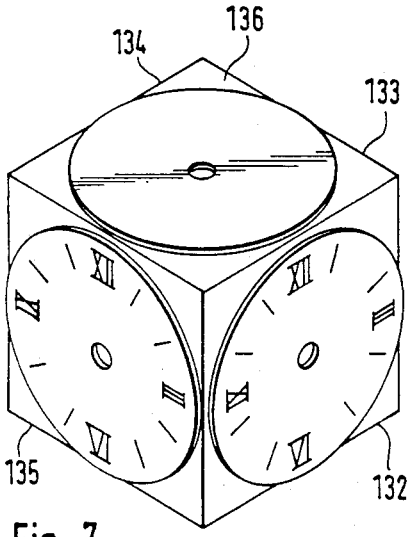
Fig. 7
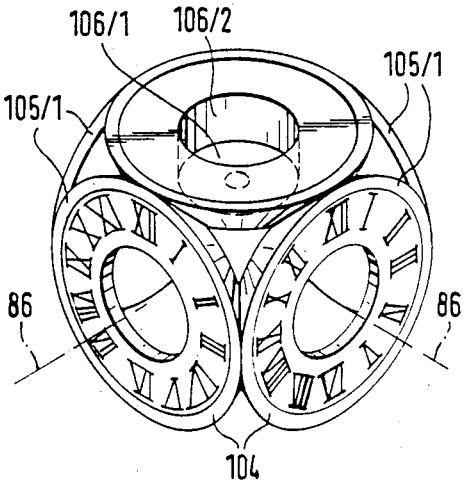
Fig. 8

Fig. 10
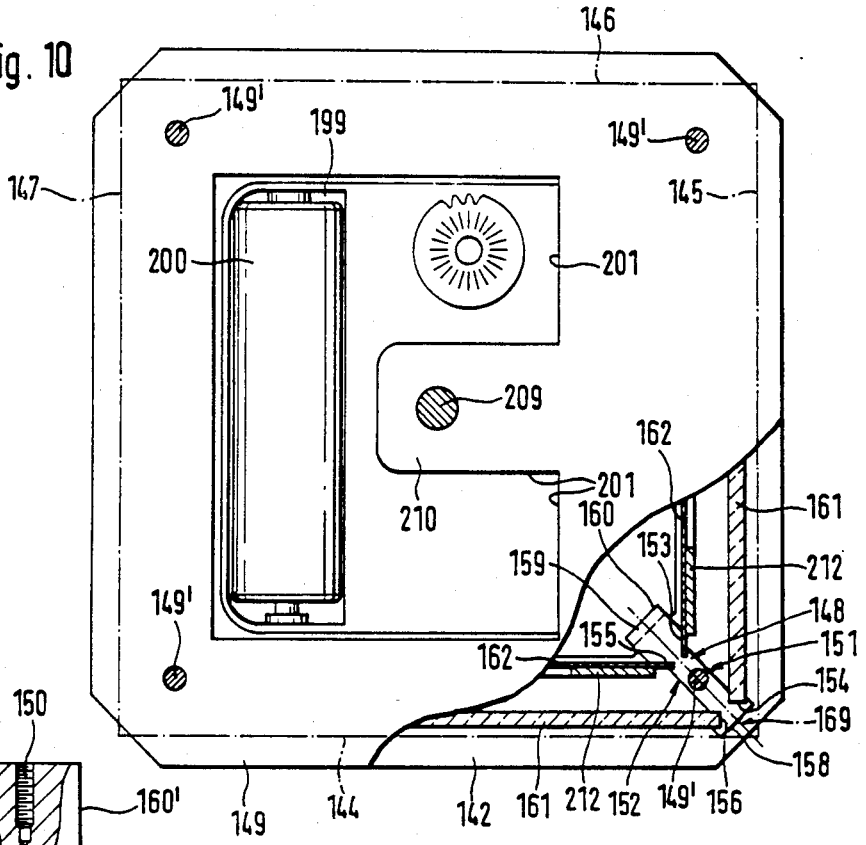
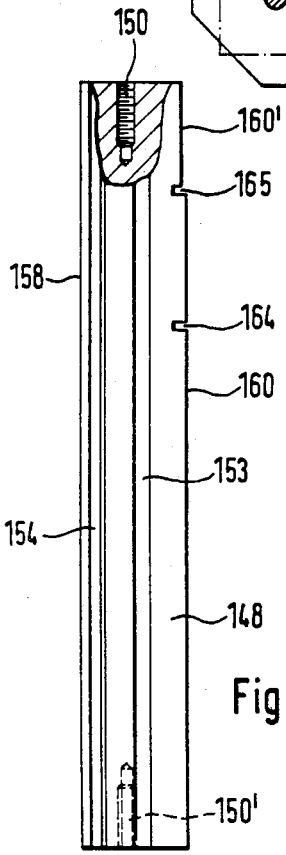
Fig. 11
Fig. 12
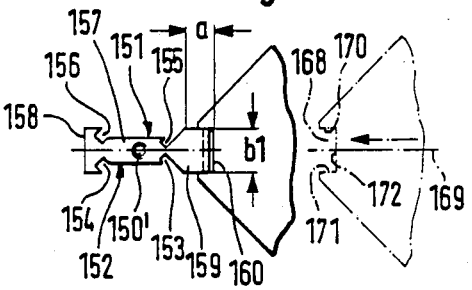

CLOCK, IN PARTICULAR DESK OR WALL CLOCK, WITH ONE OR MORE ANALOG TIME INDICATING DEVICES

The invention relates to a clock, in particular a desk or wall clock, with three or four hand systems which are disposed at 90 degree angles to each other about a vertical axis and whose axes are essentially horizontal and intersect the vertical axis, the minute hand shafts and the hour shaft tubes of the hand systems being provided with auxiliary minute gears and auxiliary hour gears, respectively, each meshing with a transmission gear disposed coaxial to the vertical axis in the manner of an angle gear and driven by a vertical shaft which is driven by a clock movement.

As is known, the known desk and wall clocks have only one indicating device each, consisting of an hour hand, a minute hand, possibly a second hand and a dial on which normally an hour and minute scale is arranged. There are purely mechanical clocks whose timing control consists of a pallet system with balance wheel and pendulum, and socalled quartz clocks in which the natural oscillations of a quartz crystal, reduced electronically, control a step motor, which moves one step e.g. every second, which motion is transmitted with appropriate gear reduction to the second shaft or, if there is no second shaft, directly to the minute shaft. But there are also pendulum clocks in which the pendulum is only a dummy and is no longer used as timing element, the clock movement rather consisting of a quartz system which also furnishes to the pendulum, via suitable coupling devices, the drive pulses needed to keep its oscillation on going.

All of these clocks have the feature in common that the dial face is in a plane transverse to the common minute and hour shaft plane, to which the shaft and drive axes of the gear system are also perpendicular.

Also known already is a hand system drive of a tower clock (CH-PS No. 153,538) in which a central drive shaft is time dependently driven by a clock movement. However this drive shaft involves neither a second shaft nor a minute shaft, if a second shaft is understood to be a shaft which makes a complete revolution in one minute, or if a minute shaft is understood to be a shaft which performs a complete revolution in sixty minutes. Due to the speed-up gear transmissions between the bevel gears of the auxiliary minute shafts on the other, the drive shaft cannot be driven at the minute shaft speed. Due to these transmission ratios, the drive shaft rotates at a speed reduced by the factor of the transmission ratio versus the minute shaft. The same applies analogously also to the bevel gears through which the auxiliary hour tubes are driven by the drive shaft.

The reason why the bevel gears mounted on the driven shaft are of larger diameter than the bevel gears of the auxiliary minute shafts and auxiliary hour tubes is that, in the given arrangement, the bevel gears of the auxiliary minute shafts or of the auxiliary hour tubes must not engage each other because this would prevent their turning.

This known hand system drive is peculiar also with respect to the direction of rotation of the central drive shaft. Specifically, the direction of rotation of the central drive shaft is opposite to that of a minute shaft and of an hour tube of a clock movement disposed below the hand gear system. It is also for this reason that the central bevel gear is disposed on the side opposite the drive relative to the plane of the hand shaft axes, and a gear is provided between a spur gear of the central drive shaft and the bevel gear of the one auxiliary hour tube.

It is evident therefrom that the conditions prevailing in the known hand system drive cannot be transferred to a desk or wall clock driven by a quartz movement.

It is an object of the invention to create a clock of the kind described in which a commercial, mechanically or quartz controlled movement with a minute shaft, an hour tube and possibly a second shaft can be used in which the rotary motions of these shafts are each transmitted in a 1:1 ratio directly by means of the simplest possible and easily installable transmission components to the several hand shafts present and disposed at an angle of at least approximately 90° to each other, thereby creating at the same time the possibility of driving dummy pendulums swinging back and forth or preforming rotary motions.

According to the invention, this problem is solved by the features stated herein which assure that the auxiliary minute gears, auxiliary hour gears and possibly auxiliary second gears, each meshing with a common transmission gear, do not make mutual contact in the plane of their axes and yet are driven in a 1:1 ratio.

This affords the advantage that the dials of the indicating devices, of which a maximum of four is present, can be arranged in a plane exactly axis-parallel to the vertical center axis of the clock.

The principal advantage of this solution according to the invention is that a clock with any desired time-controlled movement having a minute shaft and an hour tube can be built with the same basic structural design to have two, three or four time displays, e.g. a desk clock with four dials disposed at right angles to each other, or also a pendulum clock with only one dial and/or with a dummy pendulum driven by the second shaft. Due to the use of a crown gear transmission according to the main features of the invention as stated herein, it presents no difficulty to arrange the axes of the auxiliary hour gears or auxiliary minute gears exactly perpendicular to the hour tube axis so that the dials may also lie in planes parallel to the hour tube axis.

The possibility also exists to equip all hand systems with a second indicator and/or to drive a dummy pendulum by means of the vertical second shaft.

The embodiment according to a particular housing feature stated herein is provided in order to obtain the simplest possible mounting and assembly of the auxiliary hour gears and auxiliary minute gears or of the auxiliary hour tubes and auxiliary minute shafts.

The same purpose, namely the achievement of a simple manufacturing and assembly possibility is served by the embodiment according to a particular pocket shaped cavity feature stated herein, while the embodiment per a particular centering rib and bearing hub feature stated herein relates to an advantageous possibility of creating a clock which has two, three or four dial faces with the usual hour and minute hands as well as a centrally mounted second hand each, there being the additional possibility of driving a dummy pendulum directly by the second shaft.

To equip a desk clock of the kind described with a simple arrangement of and drive mechanism for a dummy pendulum, making possible at the same time a simpler mounting, a simpler assembly, less space requirement and the use of fewer parts and, above all, being suitable also for clocks having several analog time indicating devices disposed at right angles to each other, it is provided according to this particular feature that the rotating dummy pendulum is disposed coaxial with the second shaft above the hand axes of the time indicating devices and driven by the second shaft via a speed-increasing transmission and a spring-elastic intermediate element.

Apart from the advantages resulting directly from the above described problematic, another advantage of this embodiment of the desk clock according to the invention consists in that the dummy pendulum can be arranged so that its axis of rotation or oscillation coincides with the central axis of the clock housing or frame or with the second shaft axis, and in that no separate shaft nor any costly bearings are required to mount the rotating dummy pendulum disposed above the time indicating devices. In addition, it is possible to drive the dummy pendulum, which may consist of a rotating part of any physical shape such as a disc carrying geometric, spherical, conical, pyramidal or other figures, continuously directly from the second shaft always in the same direction of rotation at a speed corresponding approximately to the maximum rotary speed of a conventional, swinging, rotating pendulum e.g. of a socalled 400-day clock. The surprising effect occurs here that the casual viewer of the continuously turning rotary dummy pendulum does not notice, at least not at once, that this rotary dummy pendulum performs no swinging motions, but a continuous rotary motion. It can be made certain through the elastic intermediate element that, especially if the moment of inertia of the rotary dummy pendulum is very small, the rotary dummy pendulum can be caused to rotate from a standstill directly by the second shaft without thereby hindering the second shaft from performing its relatively fast stepping motions.

However, in order to be able to use also rotary dummy pendulums with a greater moment of inertia it is of advantage to provide a friction clutch according to a particular feature stated herein, or to mount this friction clutch in accordance with a particular spring elastic element feature stated herein.

The embodiment of the invention according to a particular flat coil or helical spring arrangement feature stated herein is of advantage both without the mentioned friction clutch and in combination with it, because this embodiment of the spring-elastic element assures the advantage of a relatively flat spring characteristic over a relatively large angle of rotation and because it also provides the further possibility of designing the flat coil spring according to a particular feature herein at the same time as a brake spring, thereby transferring to it the function of the friction clutch.

The embodiment of the invention according to a particular freely rotatable dummy pendulum feature stated herein results in a particularly simple mounting of the rotary dummy pendulum and, additionally, in the advantage that the rotary dummy pendulum, turning on the second shaft, turns in the second shaft drive direction so that a turning resistance counteracting the stepping motion of the second shaft is as good as not present. In view of the relatively small drive torques available in such clocks, this advantage is of not inconsiderable importance for the function of the entire drive system or rotary pendulum mechanism.

In order to be able to manufacture the desk clock according to the invention with as few components and as cheaply as possible and, above all, assemble it easily and construct it in skeleton fashion e.g. in the style of conventional pendulum clocks, the embodiment of the invention according to a particular cubical hollow part clock face support feature stated herein is provided.

The special advantage of such a design and connection of the clock face supports makes possible not only a less costly production of the clock face supports as a molded part produced in one piece e.g. by the injection molding method, but also the advantage that the four time indicating systems with the associated gearing parts can be preassembled completely and need then only be placed on the likewise preassembled lower frame portion with the time movement. It goes without saying that the physical appearance of the hollow part formed by the clock face supports is suited for numerous variations and can be adapted to many style trends without causing thereby a noticeable cost increase or a more complicated assembly.

By embodying the innovation according to a particular cup like depression cover plate feature stated herein the possibility is also created of disposing and driving on the top side of the clock a continuously revolving or swinging style element, it being possible to accommodate in the depression an additional transmission or else parts of the style element.

The features of a particular annular disc clock face arrangement stated herein impart the necessary stability to the hollow part consisting of annular discs or provide the conditions for making the annular discs relatively thin-walled.

Further, especially assembly advantages result from the embodiments of the invention according to a particular arrangement feature stated herein of a cubical gear housing of counterpart cubical shape to the hollow part clock face support having an open underside.

In order to make easy assembly of the upright housing and of the movement with multiple display possible for a desk clock with an upright housing, and in order to make the movement easily accessible for replacement of the electrical energy source or to set the hands, the embodiment of the invention according to a particular, e.g. glass pane vertical mounting post type, rectangular clock housing arrangement feature stated herein provides that the vertical posts disposed in the corners of a rectangular, in particular square, plane surface have a cross-sectional shape jutting out diagonally inward from the vertical slots of said vertical posts and that the diagonal insides of the vertical posts are each provided with at least one horizontal bearing surface or recess which is located above or below a horizontal hand axis plane and on which or in which at least one plateshaped or ringshaped support element is mounted in horizontal position, the support element carrying the movement is central, vertical position of its hour, minute and/or second shaft axes.

It presents no difficulties here to design a support element mounted e.g. on or in the bearing surfaces or recesses above the hand axes plane as injection molded plastic part and to provide it with an integrally molded-on holder for an angular hand shaft transmission. However, if one wants to save the die costs for the injection mold of such an injection molding, a simple assembling possibility can be achieved by the embodiment according to the above rectangular clock housing arrangement feature stated herein.

Other advantageous embodiments of the invention are contained in particular vertical post bearing surface or recess, and setting knob cutout cover plate, features stated herein, and especially in the example description below.

Several embodiment examples of the invention are illustrated in the annexed drawing and explained in greater detail in the following:

FIG. 5 shows the arrangement of a clock wheel works in connection with another housing having several time indicating devices, shown in section;

FIG. 7 shows a hollow part comprising four clock face supports in annular disc shape, as detail;

FIG. 8 shows a cubical hollow part whose side walls form the clock face supports;

FIG. 10 shows a sectional view from FIG. 9;

FIG. 11 shows a vertical post in partly sectioned side view;

FIG. 12 shows a vertical post with a corner section of a support element coming up to it, in top view.

Figure 1:
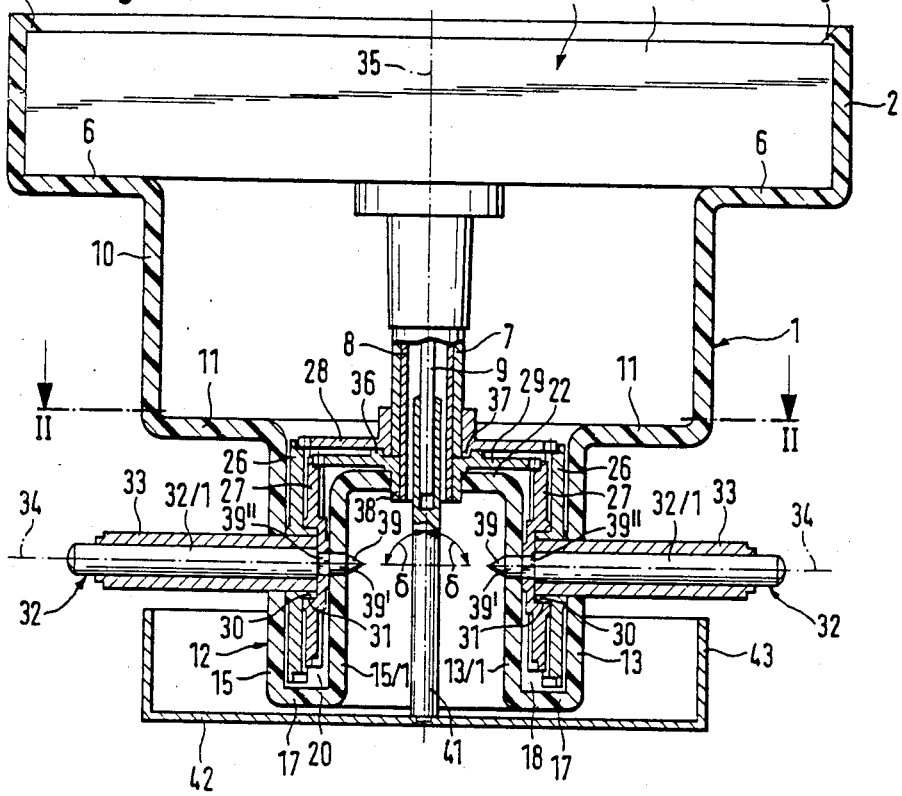
FIG. 1 shows the arrangement of a clock wheel works in a housing with several time indicating devices in section.

In the clock illustrated in FIG. 1 there is accommodated in the rectangular upper part 2 of a housing 1 preferably consisting of plastic, a commercial, quartz-controlled movement 3. The movement 3 is encased on all sides by a movement housing 4 which is held together by means of spring-deflectable detent teeth 5 disposed on the inside of the sidewalls of the upper housing part 2. The movement housing 4 rests on a horizontal bottom wall 6. The movement 3 has in its center an hour tube 7, a minute shaft 8 designed as hollow shaft and a central second shaft 9, all of which penetrate a housing center part 10 which is of square cross-section, is integrally molded to the bottom wall 6 and has a smaller inside width than the upper housing part 2.

Figure 3:
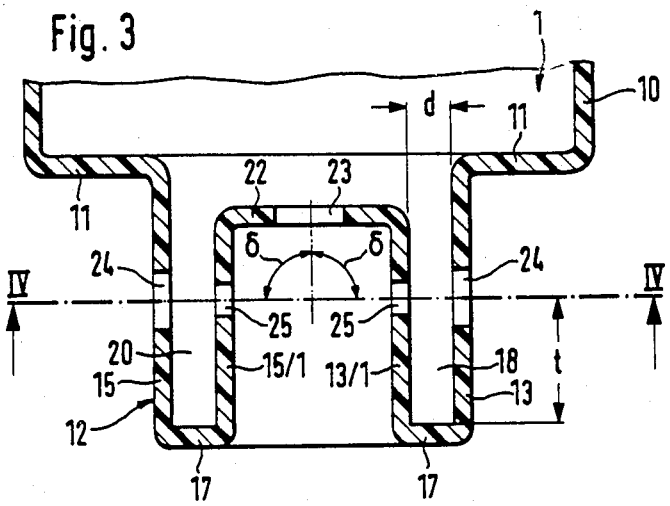
FIG. 3 shows the lower portion of the empty clock housing in section.

By means of a second bottom wall 11 oriented radially inward the central housing part 10 is connected to a gear box 12 consisting of four double walls 13, 13/1; 14, 14/1, 15, 15/1 and 16, 16/1 which form the outline of a small square and are each integrally interconnected by bottom wall webs 17 of the same width, enclosing between them pocketshaped cavities 18, 19, 20 and 21. The inner wall elements 13/1, 14/1, 15/1 and 16/1 are interconnected by a horizontal supporting wall 22 which is parallel to the bottom walls 6 and 11 and has a central bearing hole 23. The double walls 13 to 16/1 are each provided with holes 24, 25 disposed coaxial with each other in pairs. The diameter of the holes 24 is greater than that of the holes 25. The pocketshaped cavities 18 to 21 serve the accommodation of auxiliary hour gears 26 and auxiliary minute gears, each meshing jointly with transmission gears 28, 29. The auxiliary hour gears 26 and the auxiliary minute gears 27 are centered in each other concentrically by cylindrical hub extensions 30 and corresponding recesses 31. While the auxiliary minute gears 27 are each fixed on an auxiliary minute shaft 32 so as to corotate with it, the shafts 32 being rotatably mounted in the respective hole 25 of an inner double wall element 13/1, 14/1, 15/1, 16/1, auxiliary hour tubes 33, mounted rotatably on the minute shafts 32 on the one hand and in the holes 24 of the outer double wall elements 13, 14, 15, 16 on the other, are pressed, secured against rotation, into the hubs of the auxiliary hour gears 26. It may be seen from FIGS. 1 and 3 that the axis angles delta between the axes 34 of the auxiliary minute shafts 32 and the common axis 35 of the hour tube, the minute shaft 8 and the second shaft 9 are 90° each.

Figure 2:
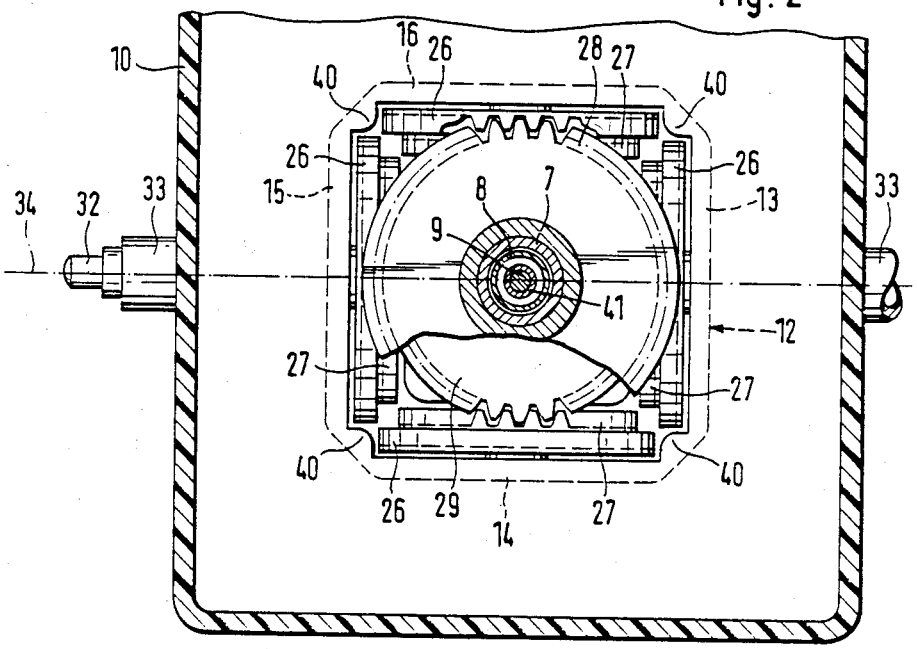
FIG. 2 shows a section II—II from FIG. 1.

It may be seen from FIG. 2 that auxiliary hour gears 26 and auxiliary minute gears 27 are disposed in pairs in all four pocketshaped cavities 18, 19, 20 and 21. It is also evident from FIG. 1 that the transmission gear 28 fastened on the hour tube 7 has a diameter greater by twice the tooth depth of its spur teeth than that of the transmission gear 29 which is fastened to the minute shaft 8 and also has spur teeth. The auxiliary hour gears 26 and the auxiliary minute gears 27, on the other hand, are not spur gears, but are designed as crown gears. The diameter of the auxiliary hour gears 26 is smaller by twice the tooth depth of their teeth than the diameter of the transmission gear 28 of the hour tube 27 with which they mesh, and the diameter of the auxiliary minute gears 27 is smaller by twice the tooth depth of their teeth than the diameter of the transmission gear 29 with which they mesh and which sits on the minute shaft 8. This makes it possible to accommodate three or four auxiliary hour gears 26 and auxiliary minute gears 27 in the pocketshaped cavities 18, 19, 20 and 21 in the manner shown in FIG. 2 without engaging each other while being able to mesh jointly with the transmission gears 28, 29. Because it is not possible to have the mutually meshing gears engage each other as pure V-zero drives, gearing in the manner of a V-plus drive is provided in order to achieve a greater isogonality of the transmission system so that, despite the different diameters of the gransmission gears 28 and 29 on the one hand and of the auxiliary hour gears 26 and auxiliary minute gears 27 on the other, a 1:1 transmission ratio is made possible. The transmission gears 28 and 29 are also centered in each other by an annular rib 36 and a hub extension 37 engaging it. The transmission gear 29, sitting on the minute shaft 8, is guided additionally in the hole 23 of the horizontal supporting wall 22 by means of a bearing hub.

To obtain a form-closing rotary connection between the auxiliary minute gear 27 and the auxiliary minute shaft 32, the latter is provided with a square section 39" and the auxiliary minute gear 27 with a matching square hole. Adjoining the square section 39" whose cross-sectional diagonals correspond to the diameter of the cylindrical portion 32/1 of the auxiliary minute shaft 32, is a smaller diameter bearing journal 39' which is mounted in the hole 25 and has a conical point 39.

The radial depth t as well as the width b and the thickness d of the pocket-shaped cavities 18, 19, 20 and 21 are selected so that an auxiliary minute and auxiliary hour gear pair 27/22, nested in each other for centering, can be installed jointly from the open top into one of the pocketshaped cavities 18 to 21 and that, in doing so, the periphery of each larger auxiliary hour gear 26 is centered so that its hub bore is offset only slightly relative to the hole 24 in the outer double wall element 13, 14, 15 or 16, providing the possibility of sticking the auxiliary minute shaft 32 having the coinical point 39 in this position through the square hole of the auxiliary minute gear 27 into the hole 25 of the inner double wall element 13/1, 14/1, 15/1 or 16/1, or of pressing the auxiliary hour tube 33 into the hub bore of the auxiliary hour gear. This affords a very simple possibility of fastening the auxiliary hours gears 26 and auxiliary minute gears 27 to an auxiliary minute shaft 32 or auxiliary hour tube 33.

The corner ribs 40 jutting out inwardly are a result of this design of the pocketshaped cavities 18 to 21. The thickness d of the cavities 18 to 21 corresponds to the joint hub length of the two auxiliary hour and auxiliary minute gears 26 and 27 which are nested in each other for centering so that they can turn with little axial clearance and are kept in engagement with the transmission gears 28 and 29.

Figure 4:
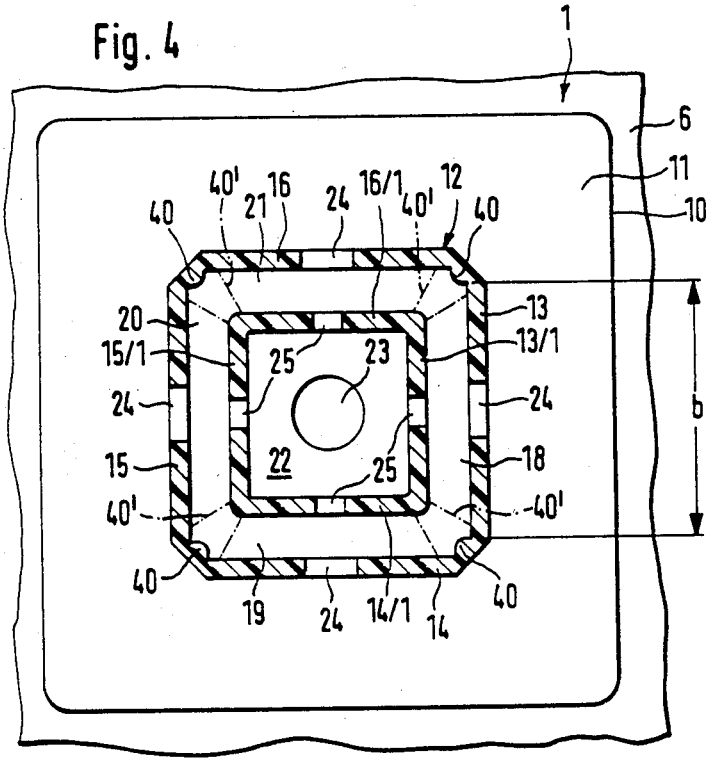
FIG. 4 shows a section IV—IV from FIG. 3.

It is also possible to omit the bottom webs 17 between the outer double wall elements 13 to 16 and the inner double wall elements 13/1 to 16/1 and to provide connecting webs 40 in the corners only, as shown in FIG. 4 in dash-dotted lines. In this case, each one of the cavities 18 to 21 may be provided, for centering the auxiliary hour gear 26 relative to the holes 24 and 25, with appropriate supporting ribs or supporting fingers, not shown in the drawing, on which the auxiliary hour gears can rest loosely until they are subsequently centered definitely in the above described manner.

Press-fitted to the free end of the second shaft 9 is an auxiliary shaft 41 to which is concentrically fastened a cylindrical drum 42. The outer surface 43 of this drum may bear any kind of markings such as an advertisement which may be made visible e.g. through a window opening 44 (see FIG. 5) so that its stepping motion can be observed to indicate to the observer that the clock is running.

The clock shown in FIG. 5 differs from that of FIGS. 1 to 4 essentially in that the outer wall elements 13, 14, 15 and 16, of which the wall elements 13, 15 and 16 only are visible, are extended straight up, and in that the movement housing 4 rests directly on their upper ends. By means of a central hollow screw 53 there is fastened to the movement housing 4 a fastening disc 55 equipped with detent pawls 54 in such a manner that the teeth 56 of the detent pawls 54 can snap into openings 57 in the double wall elements 13 to 16 when placing the movement 3 on them. This, too, makes the assembly very easy.

Figure 6:
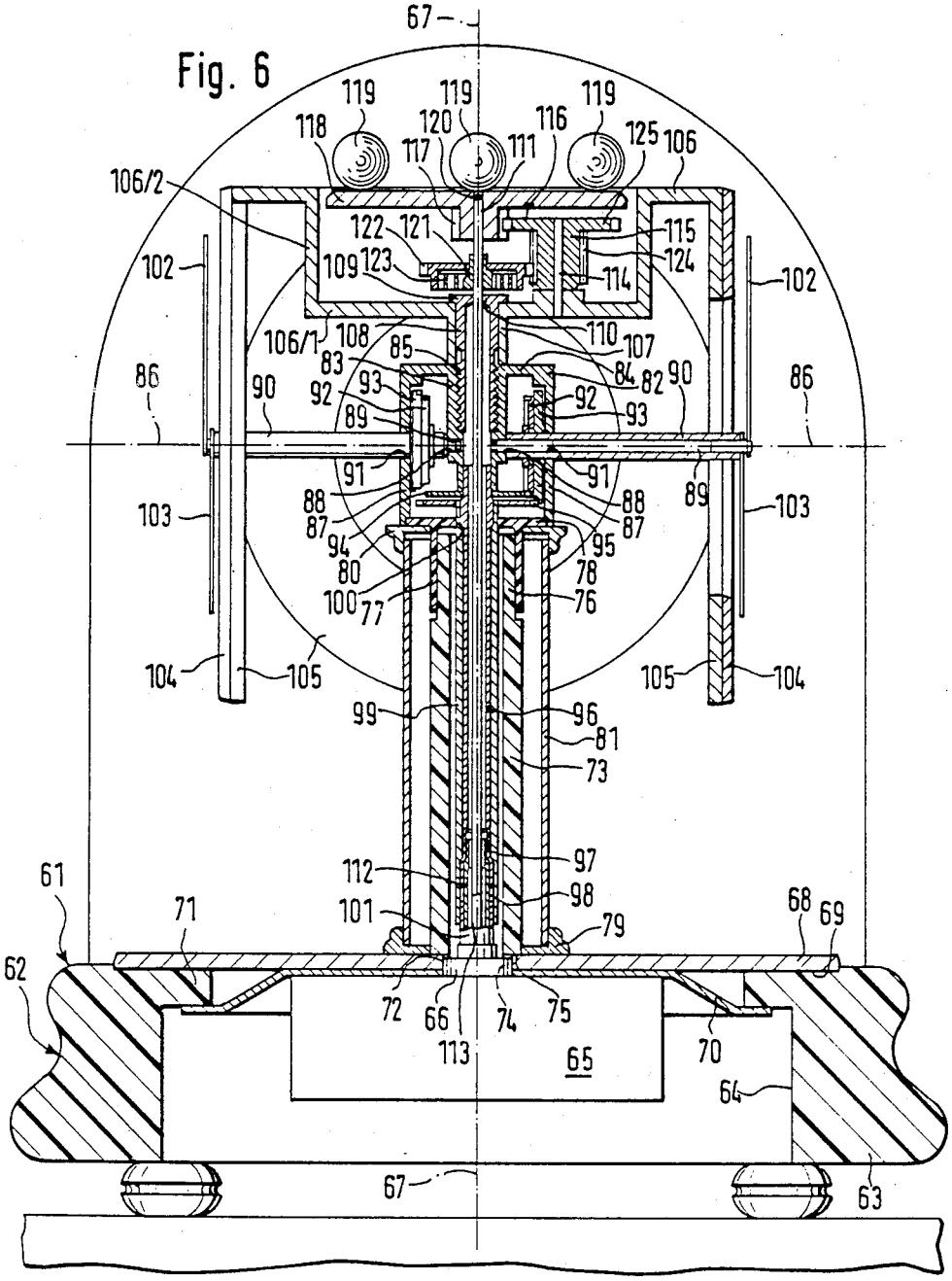
FIG. 6 shows an upright desk clock with four time indicating devices and a rotary dummy pendulum disposed above the time indicating devices concentric with the housing center axis.

The desk clock shown in FIG. 6 has a base 61 consisting of a ring part 63 which is provided with an outer ornamental profile and in whose cylindrical cavity 64 an electrically operated, commercial quartz moment 65 is disposed in such a manner that the axis of its threaded hollow hub 66 coincides with the center axis of the base 61. A circular base plate 68, preferably consisting of metal and resting concentrically on the ring part 62 in a depression 69, serves as load-carrying element. The base plate 68 is secured in this position by means of a thin spring disc 70 disposed between the base plate 68 and the housing of the quartz movement 65 and engaging an inwardly projecting flange ring 71 of the ring part 63. Instead of this design, however, the ring part 63 and the base plate 68 may also be one integral plastic part. The threaded hollow hub 66 of the quartz movement 65 sits in a central hole 72 in the base plate 68, which at the same time takes care of centering relative to the center axis 67. Screwed from the top into the threaded hollow hub 66 is an upright tube 73 which has at its lower end a thread 74 fitting the threaded hollow hub 66 and rests on the rim of the hole 72 by means of a radial, annular shoulder 75. The upright tube may be made of metal or, less expensively, of a suitable plastic of the required dimensional stability. Fastened to the smaller diameter upper end section 76 of the upright tube 73 by means of a cylindrical nipple 77 is a face plate 78 which is of square shape and is integrally joined to the nipple 77 as injection molded plastic part. The nipple 77 and the end section 76 of the upright tube 73 are press-fitted together to prevent rotation. Disposed concentric with the center axis 67 around the upright tube 73 by means of ornamental rings 79 and 80 is an e.g. brass colored or gilded shielding tube 81 which completely envelopes both the upright tube 73 and the nipple 77 so as to make these parts invisible from the outside. The ornamental ring 79 is centered on the upright tube 73 and the ornamental ring 80 on the nipple 77. Both ornamental rings 79 and 80 are provided with cylindrical recesses whose diameters are in harmony with the outside diameter of the shielding tube 81, the two ends of the shielding tube 81 projecting into said recesses at least partly.

Mounted to the face plate 78 which is fixed to the upright tube 73 is a cubical gear housing 82 whose side walls 87 are each fastened in self-retaining fashion to the edges of the face plate 78 by means of detent or snap-in connecting elements in such a manner that in assembly, the gear housing 82 need only be placed on top of the face plate 78 from the top, exerting a certain axial pressure. This cubical gear housing 82 has a hollow bearing hub 83 which is coaxial with the center axis 67, is molded to the inside of the gear housing cover 84 and has an internal thread 85 extending from the top not quite to half the housing height. In a horizontal plane in which the axes of symmetry 86 of the vertical side walls 87 of the gear housing 82 lie radially perpendicular to the center axis 67, the bearing hub 83 has four radial bearing bores 88 which are coaxial with the axes of symmetry 86 of the individual side walls 87 and in which the inner ends of minute hand shafts 89 are mounted which, in turn, are located in hour hand tubes 90. Each of these hour hand tubes 90 are rotatably mounted in cross holes 91 of the side walls 87 of the gear housing 82. They each assume a horizontal position relative to the axes of symmetry 86, and each pair forms a right angle, which means they are each exactly perpendicular to the outside surfaces of the side walls 87 of the cubical gear housing 82. Inside the gear housing 82, between the side walls 87 and the bearing hub 83, gears 92 and 93 are press-fitted to the respective minute hand shafts 89 and hour hand tubes 90 so as to be secure against rotation. The gears 92, mounted to the individual minute hand shafts 89, engage a common minute gear 94, and the gears 93, mounted to be individual hour hand tubes 90, engage a common hour gear 95, without making contact with each other, however. The minute gear 94 is fastened to the upper end section of an extension tube 96 which projects in centering fashion into the lower end of the bearing hub 83 of the gear housing 82 and which, being coaxial with the center axis 67 and disposed within the upright tube 73, is coupled to the minute tube 98 of the quartz movement 65 by means of a coupling 97. The hour gear 95, whose diameter is bigger by twice the tooth depth of the minute gear 94 than the diameter of the minute gear 94, sits analogously on an extension tube 99 which penetrates a central hole 100 in the face plate 78 and whose lower end is coupled to the hour tube 101 of the quartz movement 65. Consequently, the quartz movement 65 drives both the minute gear 94 and the hour gear 95 via the extension tubes 96 and 99, as well as the gears 92 and 93 meshing with the latter, the horizontal minute hand shafts 89 and the hour hand tubes 90, each synchronously and in the same direction. The equally long minute hand shafts 89 and hour hand tubes 90 are provided at their outer ends, relatively far away from the gear housing 82, with minute hand 102 and hour hand 103, respectively, in the back of which circular dials 104 are provided. The dials 104 are each disposed on dial supports 105 consisting of circular ring discs and integrally interconnected at their lateral edges in the area of the plane lying at the level of the axes of symmetry 86, as may best be seen in FIG. 8, being furthermore interconnected integrally by a horizontal cover plate 106. This cover plate 106 has at the underside of its bottom 106/1 a cuplike depression 106/2 with a hollow hub 107 whose lower face rests on the gear housing cover 84 and is coaxial with the center axis 67. Disposed in this hollow hub 107 in centering fashion is a threaded flange bushing 108 whose lower end is screwed into the internal thread 85 of the bearing hub of the gear housing 82 and whose upper end has a ring flange 109 which rests on the outside surface of the bottom 106/1. At the same time, the upper end of the threaded flange bushing 108 is designed, by means of an appropriate constriction, as radial bearing 110 for an extended second shaft 111 which is connected by a coupling 112 to the second shaft 113 of the quartz movement 65, penetrating coaxial with the center axis 67 both the extension tube 96 and the bearing hub 83 of the gear housing 82 as well as the threaded flange bushing 108.

In the bottom 106/1 of the cupshaped depression 106/2 is disposed, parallel to the center axis 67 and eccentric thereto, a bearing pin 114 on which a back gear 115 of a transmission 116 is rotatably mounted, through which a rotary dummy pendulum in the form of a round disc 118 with spherical ornaments 119 and equipped with a pinion 117 and freely movable on the second shaft 111 is rotatably mounted by means of a ball or jewel bearing 120.

Directly above the ring flange 109 there is press-fitted to the extended second shaft 111 so as to corotate with it a hub sleeve 121 on which is rotatably mounted a gear 122 designed like a spring housing. In the cylindrical cavity of this gear 122 is a flat coil spring 123 designed as brake spring in that its inner end is fastened to the hub sleeve 121 while its outer end contacts the cylindrical inside surface due to the preload given it when it was wound in, thus forming a friction clutch with the gear 122. The gear 122 meshes with the pinion 124 of the back gear 115 whereas the gear 125 of the back gear 115 meshes with the pinion 117. Due to this transmission 116 a transmission ratio of about 1:20 exists between the second shaft 111 and the round disc 118. This transmission ratio may vary within wide limits, depending on the inertia of the rotary dummy pendulum consisting of the round disc 118 and the ornaments 119. If the inertia of the rotary dummy pendulum to be driven in this manner is very small, the transmission ratio can be stepped up or the possibility exists to do without the friction clutch and to connect the outer end of the flat coil spring 123 rigidly to the gear 122 so that the flat coil spring merely performs a buffer function or smoothing function for the drive pulses of the stepwise turning second shaft 111.

If, as in the present embodiment example, the flat coil spring 123 is designed as brake spring, it must be selected so that the maximum friction or positive torque transmittable by it to the gear 122 is not greater than the driving torque received by the extended second shaft 111 from the quartz movement 65. If this condition is met there is assurance that the second shaft 113 or the extended second shaft 111, and with it also the members of the time display, will not stop when the rotary dummy pendulum is prevented from rotating for whatever reasons or must be caused to rotate from a standstill. Since the drive torques available in commercial quartz movements of interest here range approximately between $0.2\times10^{-3}$ Ncm and about $5\times10^{-3}$ Ncm it is necessary, if the rotary dummy pendulum is to be accelerated relatively quickly to its maximum rotary speed, to keep the inertia of the rotary dummy pendulum low, such that the dummy pendulum should be made of a material as light as possible with the least possible total mass and small radius.

The embodiment described above with reference to FIG. 6 offers the possibility of assembling the entire drive system including the extended second shaft 111 in the following manner:

After placing the gear box 82 on top of the face plate 78 with the already preassembled gears 92 and 93, the minute hand shafts 89 and the hour hand tubes 90, the extended second shaft 111, already equipped with the hub sleeve 121, is pushed from the top through the radial bearing 110 of the threaded flange bushing 108 in bearing hub 83 and coupled to the second shaft 113 of the quartz movement 65 by means of a plug-in coupling. Thereupon, the gear 122 is pushed from the top over the flat coil spring 123 whose inner end is already fastened to the hub sleeve 121 so as to rest loosely on the upper annular shoulder of the smaller diameter hub sleeve. Then the back gear 115 is pushed over the bearing pin 114, causing its pinion 124 to engage the gear 122 at the same time. Then the round disc 118 with the ornaments 119 and its ball or jewel bearing 120 can be placed on the upper end of the extended second shaft 111 so that its pinion 117 engages the gear 125 of the back gear 115. When the quartz movement 65 starts running and the extended second shaft 111 performs its stepwise rotary motions, the flat coil spring 123 will first be loaded to a certain degree. At the same time, due to the friction, the gear 112 starts turning by and by, which then starts to turn, via the back gear 115, the rotary dummy pendulum consisting of the round disc 118 and the ornaments 119, the rotary dummy pendulum reaching its full speed only gradually.

Another design possibility for the clock faces is shown in FIG. 7. There, the four dial supports, disposed at right angles to each other, form the side walls 132, 133, 134 and 135 of a cubical hollow part open at the bottom and equipped with a square cover plate 136 which interconnects the four side walls 132 to 135. This hollow part, too, may be produced as a single piece and be equipped with a hollow hub 107 or a cuplike depression 106/2.

Of course, embodiments are also possible where a second hand shaft or an ornament or style element driven by the second shaft is omitted. In such cases, there may be provided on the cover plate 106 or on the bottom 106/3 of the depression 106/2 of the cover plate 106/1 a solid hub with an appropriate external thread onto which the bearing hub 83 of the gear housing 82 can be screwed.

As may be seen best in FIG. 8, the dial supports 105 or 105/1 consisting of annular discs are joined to each other materialwise, i.e. integrally, as they have essentially the same large outside diameter as the cover plate 106 or 106/1.

Another possibility of giving the clock face supports a special stylistic appearance is to make them convex or concave.

If the upright tube 73 consists of plastic, the face plate 78 may be molded on integrally at an upper end.

If the cover plate 106 or the bottom wall 106/3 is provided with cutouts like ring sectors and the hollow hub 107 or 107/1 with radial ribs there between, it is also possible from a molding engineering point of view to mold the hollow hub 107 integrally to the gear housing 82 together with the cover plate 106 or the bottom wall 106/1 and the clock face supports 105 or 105/1.

Figure 9:
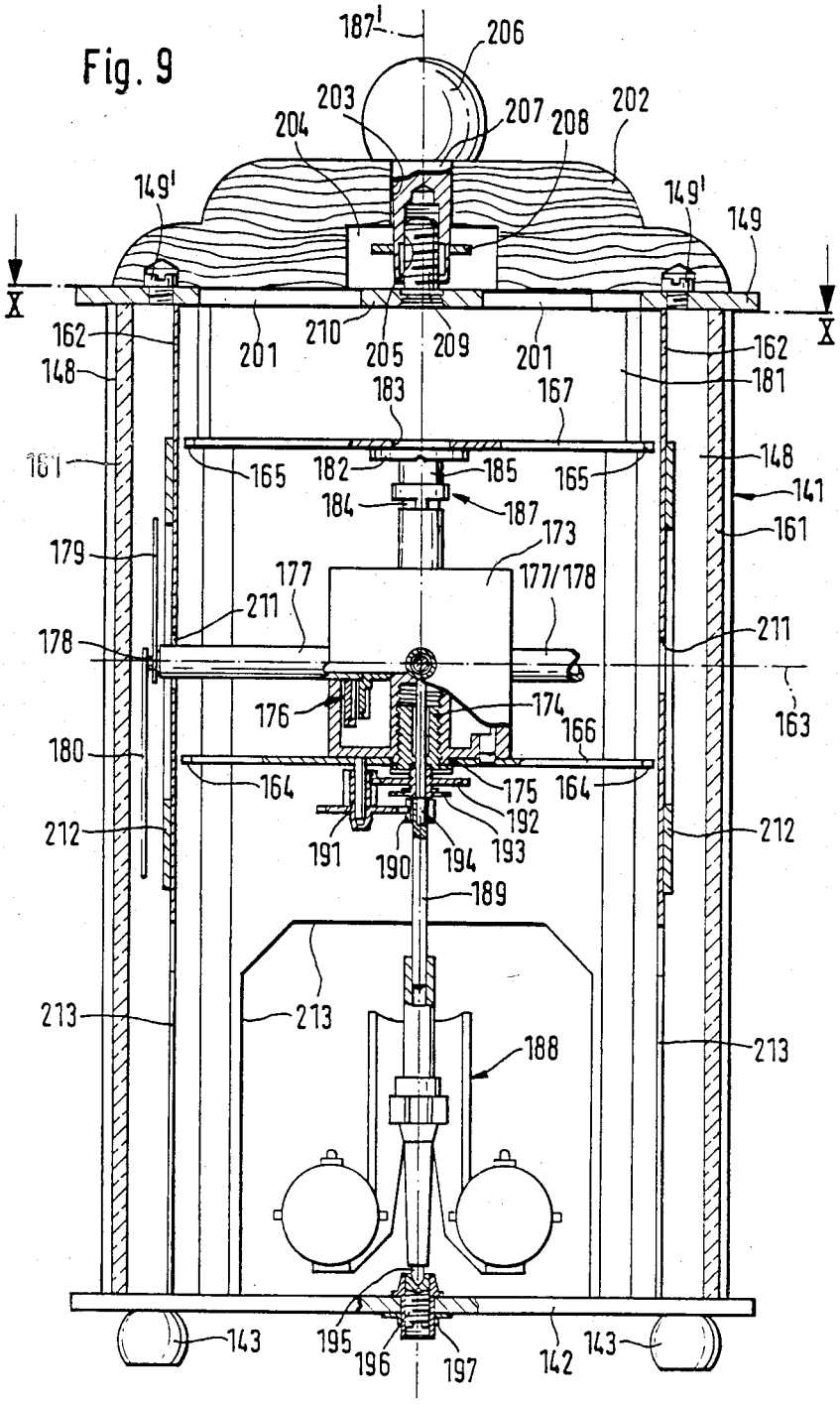
FIG. 9 shows a desk cloth of the kind described with an upright housing, with multiple display and a dummy pendulum, in partly sectioned side views.

In the desk clock shown in FIG. 9, the clock housing 1 consists of a horizontal base plate 142 which is essentially of square areal shape, with corners beveled at 45° and feet 143 attached to its underside in the usual manner. In the corners of a base area defined by dash-dotted lines 144, 145, 146 and 147 (FIG. 10) are disposed identical vertical posts 148 which are each provided on top and bottom with axial tapped holes 150 and 150' and fastened to the base plate 142 by means of threaded studs of the feet 143. Resting on the upper faces of the vertical posts148 is a cover plate 149 which is fastened to them by means of cylinder head screws 149' screwed into the upper tapped holes 150 of the vertical posts 148. As may best be seen in FIGS. 10 and 12, the vertical posts 148 are each of elongated, rectangular cross-section, both long sides 151 and 152 of which are each provided with two vertical slots 153, 154 and 155, 156, respectively, the cross-sectional part 157 located between the outer vertical slots 154 and 156 and the inner vertical slots 153 and 155 being thinner than the other parts outside of the vertical slots, in particular for stylistic reasons. While the outer vertical slots 154 and 156 are each located near the diagonal outside surfaces 158, there extends from the two inner vertical slots 153 and 155 a plane-parallel cross-sectional part 159 inwardly in diagonal direction so far that its inner vertical limiting area 170 is spaced from the vertical slots 153 and 155 by a distance a which corresponds approximately to the width b1 of this part and which is greater in any event than the distance of the outer vertical limiting areas 158 from the outer vertical slots 154 and 156. The outer vertical slots 154 and 156 serve the accommodation of side walls 161 which are at right angles to each other and consist of glass panes, while the inner, narrower vertical slots 153 and 155 serve the accommodation of auxiliary walls 162 which are also disposed at right angles to each other, run parallel to the sidewalls 161, spaced from them and forming the clock face plane. In accordance therewith, the inner and outer vertical slots are also arranged in pairs at right angles to each other. The inner limiting areas 160 of the vertical posts 148 are each provided with a first cross-slot 164 located below a horizontal hand axis plane 163 and with a second cross-slot 165 located at a greater distance above the hand axis plane 163. The lower cross-slots 164 of the vertical posts 148 each serve the accommodation of a platelike supporting element 166 in horizontal position, while the upper cross-slots 165 serve jointly the accommodation of a second platelike supporting element 167. The supporting elements 166 and 167 each consist of essentially square plates whose corners have U-shaped cutouts 168 (FIG. 12) whose leg edges 170 and 171, extending parallel to the diagonal 169, include between them the inner cross-sectional part 159 of a vertical post 148 with little clearance, whereas the transverse edge 172 of the cutout 168 projects into the cross-slot 164, resting in it. The supporting element 167 is also fastened in the upper cross-slots 165 in the same manner. The upper supporting element supports the cuboidal housing 173 of an angle transmission, which housing is so fastened in central position by means of a central hollow screw 174 which penetrates a central hole 175 in the supporting element 166 that its vertical side surfaces each run parallel to one of the side walls 161 or auxiliary walls 162. Protruding out of the side walls of the angle transmission housing 173 are the hand shafts 177 and 178 which are driven simultaneously by the quadruple angle transmission 176 and lie in the horizontal hand axis plane 163 and which also penetrate the auxiliary walls 162 and are provided in the cavities between the auxiliary walls 162 and the side walls 161 with the hour hands 179 and minute hands 180, respectively.

Mounted on the upper supporting element 167 in centered position is an electronic movement 181 whichis fastened, by means of a hollow screw 182 penetrating a central hole 183 in the supporting element 167, in such a position that the minute shaft 184, the hour tube 185 and the central second shaft 186 of the movement 181 in vertical position are coaxial with the vertical center axis 187' of the clock housing 141. The cuboidal housing 173 of the angle transmission is also disposed on the supporting element 166 to be coaxial with this vertical center axis 187. The minute shaft 184 and the hour tube 185 are each connected, via couplings 187 only sketched in, to coaxial hollow shafts of the quadruple angle transmission 176 through which they drive the four hand shafts 177/178 jointly.

Of course, the supporting elements 166 and 167 could also be of different areal shapes, e.g. a ring shape with legs extending diagonally outward.

To drive a rotary dummy pendulum 188, the vertical second shaft 186 is extended downwardly through the hollow screw 174. The upper end of the rotary pendulum shaft 189 is provided with a drive gear 190 which is in driving connection with the second shaft 186 via a back gear 191 and a gear 192 rotatably mounted on the second shaft 186 as well as a spring-loaded clutch 193, and which is continuously driven in always the same direction at a speed approximately corresponding to the average rotary speed of a rotating pendulum.

While the upper end of the pendulum shaft 189 is guided in a trunnion 194 of the second shaft 186, the lower end of the rotary dummy pendulum 188 is mounted by means of a trunnion in an axially adjustable bearing screw 196 disposed in a central bearing hub 197 of the base plate 142.

In order to make a hand setting knob and a battery compartment 199 or the electrical battery 200 disposed in this battery compartment 199 accessible, the cover plate 149 has a U-shaped cutout 201 which can be covered up by an ornamental cover 202 which also covers the screws 149'. This ornamental cover 202 may be of round or square contour. In its middle it has an axial hole 203, adjoined at the underside by a cylindrical expansion 204. Mounted in the axial hole 203 is a connecting pin 207 which has a central tapped hole 205 and is fastened to a knob 206 and secured by a pressed-on annular disc 208. This connecting pin 207 is screwed to a threaded bolt 209 seated firmly coaxial with the center axis 187 in a tongueshaped section 210 of the cover plate 149. By turning the knob 206 in the one or the other direction, the connecting pin 207, and with it the ornamental cover 202, can be detached from the threaded bolt 209 or fastened to it.

To facilitate fastening the upper supporting element 167 in the upper cross-slots 165 after the supporting element 166 has been inserted in the lower cross-slots 164 of the vertical posts 148, the sections 160' of the inner limiting areas 160 of the vertical posts 148 located above the cross-slots 165 are stepped back relative to the areal sections 160 by about half the slot depth. This is illustrated in particular in FIGS. 9 and 11.

In the above described embodiment example, the auxiliary walls 162 consist each of thin metal sheets, each having a hole 211 at the level of the hand shaft axis 163 and clock face or scale supports 212 of annular disc design on their outsides, concentric with the hand shafts 177/178. Below this clock face or scale support 212 they are provided with windowlike cutouts 213 to make the rotary dummy pendulum visible.

Of course, the possibility also exists to use glass or a similar, transparent material for the auxiliary walls 162 so as to obviate windowlike cutouts 213 to make an existing rotary pendulum or a rotary dummy pendulum 188 visible.

For the joint retention of the movement 181 and gear housing 173 there may be provided instead of the two supporting elements 166 and 167 a plastic part molded as one piece which consists of a plate-shaped supporting part resting, in a manner similar to the supporting element 167, on horizontal support surfaces of the vertical posts 148 provided at the level of the cross-slots 165 and having at its underside at least two vertical wall elements which accommodate the gear housing 173 between them, gripping it by means of pawlike detention devices. In such an embodiment, the lower supporting element 166 and the lower cross-slots 164 could be eliminated.

I claim:

1. Clock such as a desk or wall clock, comprising a clock movement having a vertical axis and provided with a vertical minute drive shaft and a vertical hour drive shaft in operative coaxial arrangement, and three or four hand systems disposed at 90 degree angles to each other about the vertical axis and whose hand system axes are substantially horizontal and intersect the vertical axis, the hand systems each being provided in operative coaxial arrangement with a minute hand shaft having an auxiliary minute crown gear and an hour hand shaft having an auxiliary crown gear, each of said minute gears meshing in the manner of an angle gear with a common auxiliary minute transmission gear disposed operatively coaxially to the vertical axis and driven by the vertical minute shaft, and each of said hour gears meshing in the manner of an angle gear with a common auxiliary hour transmission gear disposed operatively coaxially to the vertical axis and driven by the vertical hour shaft, said minute gears each having the same number of teeth as said minute transmission gear with which they mesh, and said hour gears each having the same number of teeth as said hour transmission gear with which they mesh, the teeth being in mutual engagement having a profile displacement in the manner of a V-plus gear with said minute transmission gear having a diameter larger by at least double the corresponding tooth depth than the diameter of said minute gears and said hour transmission gear having a diameter larger by at least double the corresponding tooth depth than the diameter of said hour gears.

2. Clock of claim 1 wherein the clock movement and adjacent portions of the minute drive shaft and hour drive shaft are disposed in a housing framework formation vertically spaced from the hand system shafts and gears.

3. Clock of claim 2 wherein the framework formation includes a box like hollow extension vertically adjacent the clock movement and having correspondingly three or four pocket shaped cavities defined between pairs of generally parallel inner and outer vertical side walls, each pair of side walls being disposed at right angles to the pair of side walls of the adjacent cavity for receiving a corresponding said minute shaft and minute gear and a corresponding said hour shaft and hour gear, and each pair of side walls having a guide surface region in each wall thereof at right angles to the corresponding hand system axis for operatively mounting adjacent portions of said minute shaft and minute gear and of said hour shaft and hour gear in the corresponding pocket shaped cavity defined by the pair of inner and outer side walls thereat.

4. Clock of claim 3 wherein the pairs of side walls are connected at their edge portions remote from the framework formation to form a closed inside end wall of the corresponding cavity remote from the framework formation and defining a remote end continuation thereof.

5. Clock of claim 4 wherein the edge portions of the inner side walls adjacent the framework formation are interconnected by a supporting cross wall arranged for operatively mounting said minute transmission gear and said hour transmission gear.

6. Clock of claim 5 wherein said cavities are open in the direction facing the clock movement, and the guide surface regions of the outer and inner side walls contain centering bearing surfaces for correspondingly rotatably mounting said minute shafts and minute gears and said hour shafts and hour gears.

7. Clock of claim 5 wherein the cross wall contains a bearing hub, and said minute transmission gear and hour transmission gear contain intermeshing centering ribs, the hub and ribs being operatively arranged for mutually centering said transmission gears via the ribs for relative coaxial rotation with respect to each other, and for rotatably mounting said transmission gears via the hub for rotation relative to the cross wall.

8. Clock of claim 1 wherein the clock movement is provided with a vertical second drive shaft having a drum attached thereto containing an outside surface adapted to bear visually disposed indicia such as an advertisement.

9. Clock such as a desk or wall clock, comprising a clock movement having a vertical axis and provided with a vertical minute drive shaft, a vertical hour drive shaft, and a vertical second drive shaft in operative coaxial arrangement, several analog time indicating devices disposed at right angles to each other at a level spaced from the clock movement, and operatively connected to the vertical minute drive shaft and the vertical hour drive shaft for operating the time indicating devices, and a rotary dummy pendulum disposed at a location remote from the level of the time indicating devices, and in operative coaxial arrangement with and operatively connected to the vertical second drive shaft for operating the pendulum, the pendulum being operatively connected to the vertical second drive shaft via a connection assembly including a speed increasing transmission and an elastic spring acting intermediate member.

10. Clock of claim 9 wherein the connection assembly includes a friction clutch whose power transmitting friction moment is smaller than the drive moment of the vertical second drive shaft.

11. Clock of claim 10 wherein the speed increasing transmission includes a gear link member operatively connected to the pendulum, the spring acting intermediate member is operatively connected to the vertical second drive shaft, and the friction clutch is operatively disposed between the gear link member and the spring acting intermediate member.

12. Clock of claim 9 wherein the spring acting intermediate member is in the form of a coil spring containing several turns and disposed coaxially of the vertical second drive shaft, one end of the spring being operatively connected to a hub element fixedly mounted on the vertical second drive shaft for co-rotation therewith.

13. Clock of claim 12 wherein the speed increasing transmission includes a gear link member rotatably mounted on the vertical second drive shaft and operatively connected to the pendulum, and the spring is operatively disposed in the manner of a brake spring in the gear link member.

14. Clock of claim 9 wherein the pendulum is mounted directly on the vertical second drive shaft in freely rotatable relation therewith.

15. Clock such as a desk or wall clock, comprising a generally cube like shape hollow part including four clock face supports disposed at right angles to each other and symmetrical to a vertical centerline, and forming four vertical side walls, and a horizontal top cover plate connected to the side walls and having a central inwardly directed hub portion coaxial to the vertical centerline, and four horizontal corresponding hand systems of minute and hour hands in a stationary gear housing having a top support cover, the gear housing being disposed in the hollow part with the four hand systems arranged at the four clock face side walls for being driven by transmission systems of a clock movement vertical minute drive shaft and vertical hour drive shaft arrangement, and with the inwardly directed hub portion of the hollow part resting on the gear housing top support cover.

16. Clock of claim 15 wherein the cover plate has a cup like depression concentric to the vertical centerline and from the central bottom portion of which the central hub portion is inwardly directed toward the top support cover of the gear housing, the depression being adapted to accommodate a rotary dummy pendulum.

17. Clock of claim 15 wherein the clock face supports forming the vertical side walls and the horizontal cover plate correspondingly include annular disc surface formations having the same outside diameter and integrally interconnected to each other.

18. clock of claim 15 wherein the hub portion is provided with a threaded flange sleeve, and the top support cover of the gear housing is provided with a corresponding threaded central bearing hub for threaded interconnection with the flange sleeve.

19. Clock of claim 15 wherein the hollow part has an open underside, and the gear housing has a counterpart cube like shape thereto permitting relative insertion of the gear housing into the hollow part via the open underside.

20. Clock such as a desk or wall clock, comprising a clock movement having a vertical axis and provided with a vertical minute drive shaft and a vertical hour drive shaft in operative coaxial arrangement, four analog time indicating devices disposed at right angles to each other at a vertical first level spaced from the clock movement, and operatively connected to said drive shafts for operating the time indicating devices, a rectangular clock housing containing the clock movement and time indicating devices, and having vertical side walls disposed at right angles to each other between adjacent vertical corner posts, the posts being fastened upright to a base plate and carrying a top cover plate, the posts each having vertical slots in which the side walls are correspondingly guidingly retained, the posts being elongated in cross section and diagonally disposed in an inward direction from the slots toward the vertical axis, and each post having a horizontal bearing surface at a level remote from said first level, and a horizontal support element supported by the corresponding horizontal bearing surfaces of the posts, and arranged for supporting in turn the clock movement thereon.

21. Clock of claim 20 wherein two vertically spaced apart horizontal bearing surfaces are provided on each post, one bearing surface being disposed at a second level vertically above said first level and the other bearing surface being disposed at a third level vertically below said first level, and two corresponding horizontal support elements are provided which are supported respectively by said bearing surfaces, the support element supported by the bearing surfaces at the second level being arranged for supporting in turn the clock movement thereon, and the support element supported by the bearing surfaces at the third level being arranged for supporting in turn portions of the time indicating devices thereon.

22. Clock of claim 20 wherein the housing has an interior top portion and the top cover plate has a cut out portion coverable by a removable cover for opening the interior top portion to provide access to a hand setting knob and an energy source compartment for accommodating an energy source for operating the clock movement, said knob and compartment being located in the interior top portion.

* * * * *